US009088086B2

(12) United States Patent
Tseng

(10) Patent No.: US 9,088,086 B2
(45) Date of Patent: Jul. 21, 2015

(54) DATA DEVICE WITH UNIVERSAL SERIAL BUS CONNECTOR

(71) Applicant: HON HAI PRECISION INDUSTRY CO., LTD., New Taipei (TW)

(72) Inventor: Kuan-Chih Tseng, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/217,087

(22) Filed: Mar. 17, 2014

(65) Prior Publication Data

US 2014/0322938 A1 Oct. 30, 2014

(30) Foreign Application Priority Data

Apr. 25, 2013 (CN) ..... 2013 2 02143405 U

(51) Int. Cl.
*H01R 13/44* (2006.01)
*H01R 35/00* (2006.01)

(52) U.S. Cl.
CPC ..... *H01R 13/44* (2013.01); *H01R 35/00* (2013.01)

(58) Field of Classification Search
CPC ..... H01R 35/04; H01R 31/06; H01R 13/60; H01R 13/44; H01R 2201/06; H01R 24/68
See application file for complete search history.

(56) References Cited

U.S. PATENT DOCUMENTS

| | | | | |
|---|---|---|---|---|
| 7,179,099 | B2 * | 2/2007 | Hsieh | 439/131 |
| 7,473,141 | B2 * | 1/2009 | Liao | 439/638 |
| 7,824,186 | B2 * | 11/2010 | Zhao et al. | 439/13 |
| 8,241,047 | B2 * | 8/2012 | Ni et al. | 439/131 |
| 8,292,640 | B1 * | 10/2012 | Wu et al. | 439/131 |
| 8,672,692 | B2 * | 3/2014 | Chun et al. | 439/131 |
| 8,672,693 | B2 * | 3/2014 | Liu | 439/131 |

FOREIGN PATENT DOCUMENTS

| | | |
|---|---|---|
| CN | 102176596 A | 9/2011 |
| CN | 102185232 | 9/2011 |

* cited by examiner

*Primary Examiner* — Xuong Chung Trans
(74) *Attorney, Agent, or Firm* — Novak Druce Connolly Bove + Quigg LLP

(57) ABSTRACT

A data device with a USB connector includes a main body and a USB connector. The main body includes a base portion, a first pivoting portion and a second pivoting portion. The USB connector is located between the first pivoting portion and the second pivoting portion. The first pivoting portion defines a first receiving hole, the second pivoting portion defines a second receiving hole. The first pivoting portion forms a protrusion protruding from an inner surface. The USB connector includes a positioning member, a rotating member and an elastic member. The positioning member is rotatably received in the first receiving hole, the rotating member is rotatably received in the second receiving hole. The positioning member forms a plurality of positioning gears at a circumferential surface of the positioning member.

10 Claims, 4 Drawing Sheets

DATA DEVICE WITH UNIVERSAL SERIAL BUS CONNECTOR

BACKGROUND

1. Technical Field

The present disclosure relates to data devices with universal serial universal serial bus (USB) connectors, and more particularly to a data device with a USB connector which can be adjusted to any angle.

2. Description of Related Art

USB connectors are used in data devices for transmitting data among different peripheral devices. There are different structures to combine peripheral devices and USB connector. Presently, the relevant devices occupy large space and cannot adjust the USB connector to any angle which brings inconvenience when used.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
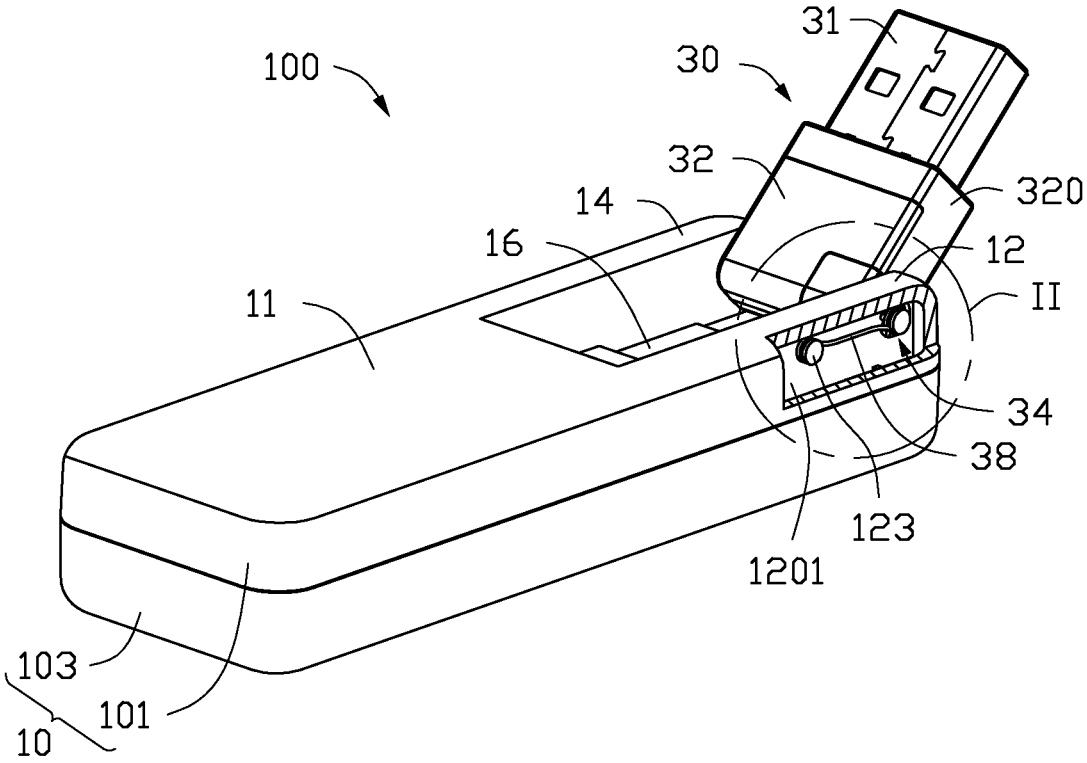
FIG. 1 is an isometric view of a data device with a USB connector in accordance with an embodiment of the presently described invention.

FIG. 1 shows a data device with a USB connector 100 of an embodiment. The date device with the USB connector 100 includes a main body 10 and a USB connector 30 positioned at one end of the main body 10.

The main body 10 includes a first cover 101 and a second cover 103 paralleling with and covered by the first cover 101. The main body 10 is mainly a concave structure. The first cover 101 and the second cover 103 each is concave structure.

Figure 2:
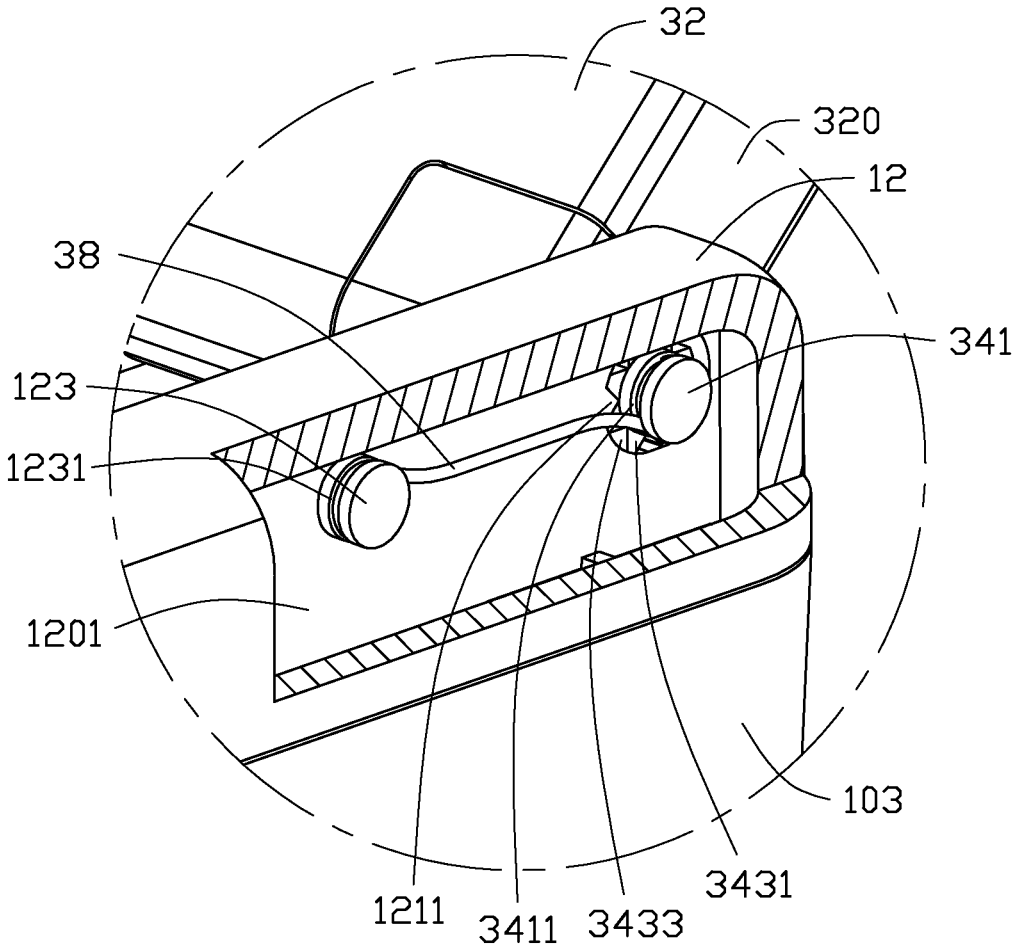
FIG. 2 is an enlarged schematic view of section II of FIG. 1.
Figure 3:
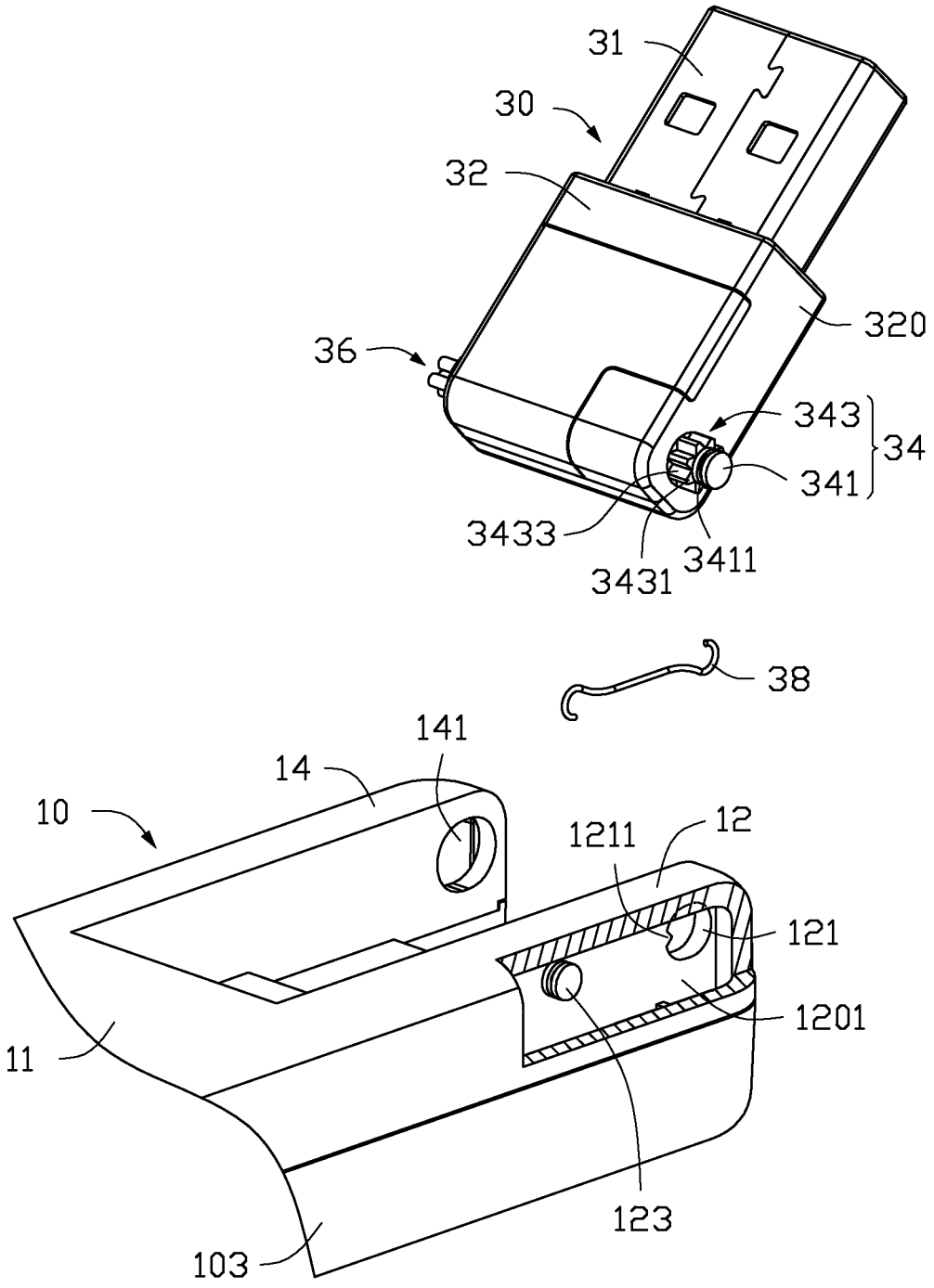
FIG. 3 is an exploded view of FIG. 1.
Figure 4:
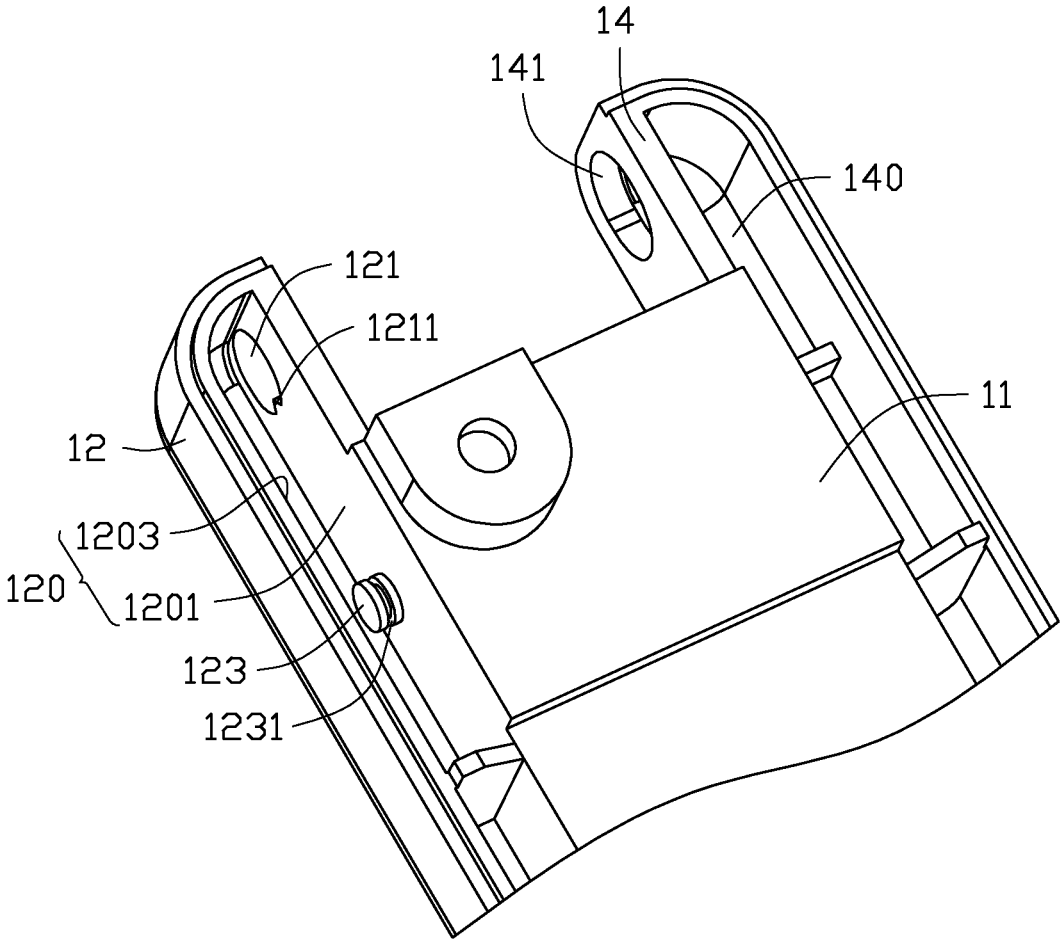
FIG. 4 is another schematic view of a first cover in FIG. 3.

FIGS. 2 to 4 show that the first cover 101 includes a base portion 11, a first pivoting portion 12 and a second pivoting portion 14. An end of the base portion 11 extends to form the first pivoting portion 12 and the second pivoting portion 14 commonly used to position the USB connector 30.

A surface of the first pivoting portion 12 facing the second cover 103 defines a first pivoting groove 120 (refer to FIG. 4). The first pivoting groove 120 includes a first surface 1201 close to and paralleling to the second pivoting portion 14 and a second surface 1203 paralleling to the first surface 1201. The first pivoting portion 12 defines a first receiving hole 121 adjacent to a distal end thereof, for connecting the USB connector 30. In present embodiment, the first receiving hole 121 has a shape of an ellipse including a long axis and a short axis vertically with the long axis. The long axis of the ellipse is an axis line linking two largest distance points on the ellipse. In present embodiment, the long axis of the first receiving hole 121 is parallel to a direction of the base portion 11 extending to the first pivoting portion 12. An inner surface surrounding the first receiving hole 121 protrudes to form a protrusion 1211 in the first receiving hole 121 used to fasten the USB connector 30. In present embodiment, the protrusion 1211 is a triangle, it can be a rectangle, a trapezoid or other shapes in other embodiments.

The pivoting portion 12 forms a protruding post 123 adjacent to the base portion 11 and juxtaposed with the first receiving hole 121. The protruding post 123 is mainly a column in shape. The protruding post 123 extends from the first surface 1201 and is received in the first pivoting groove 120. The protruding post 123 defines a first fixing groove 1231. The first fixing groove 1231 is annular in a circumferential face of the protruding post 123.

The second pivoting portion 14 is parallel to the first pivoting portion 12. A surface of the second pivoting portion 14 facing the second cover 103 defines a second pivoting groove 140. The second pivoting portion 14 defines a second receiving hole 141 in alignment with the first receiving hole 121 adjacent to a distal end of the second pivoting portion 14. In present embodiment, the second receiving hole 141 is mainly an ellipse similar to the first receiving hole 121 and used for receiving the USB connector 30. The first pivoting portion 12 and the second pivoting portion 14 can be elastically deformed.

FIG. 1 shows that a surface of the base portion 11 away from the second cover 103 defines a receiving portion 16 between the first pivoting portion 12 and the second pivoting portion 14, for receiving the USB connector 30. The receiving portion 16 is located between the first pivoting portion 12 and the second pivoting portion 14.

FIG. 2-3 show that the USB connector 30 is located between the first pivoting portion 12 and the second pivoting portion 14. The USB connector 30 includes a connecting portion 31, a connecting member 32, a positioning member 34, a rotating member 36 and an elastic member 38. The connecting portion 31 is fixed on the connecting member 32. The positioning member 34 and the rotating member 36 are located on two opposite surfaces of the connecting member 32.

The connecting portion 31 is a component used to connect peripheral devices. One end of connecting member 32 is located between the first pivoting portion 12 and the second pivoting portion 14 for connecting the USB connector 30 with the main body 10. The connecting member 32 includes a pivoting surface 320, the pivoting surface 320 is a side surface of the connecting member 32 and is parallel to and faces the first pivoting portion 12.

The positioning member 34 is located at one end portion away from the connecting portion 31 on the pivoting surface 320, the positioning member 34 is used to fasten the USB connector 30 to the main body 10. The positioning member 34 is inserted into the first receiving hole 121 to rotate, the positioning member 34 moves in a long axis direction of the first receiving hole 121 when rotated. The positioning member 34 includes a fixing portion 341 and a positioning portion 343 surrounding a surface of the fixing portion 341.

The fixing portion 341 is substantially a column, and extends from one end portion of the pivoting surface 320 away from the connecting portion 31. The fixing portion 341 forms a second fixing groove 3411 for fastening one end portion of the elastic member 38. The positioning portion 343 is located between the pivoting surface 320 and the second fixing groove 3411. The positioning portion 343 defines a plurality of positioning gears 3431. In present embodiment, the positioning gear 3431 is a triangle. A positioning groove 3433 is defined between two adjacent positioning gears 3431. The positioning portion 343 is positioned into the first receiving hole 121, the positioning gears 3431 take turns to mesh with the protrusion 1211 when the USB connector 30 is rotated.

A surface of the connecting member 32 opposite to the pivoting surface 320 defines a rotating member 36 opposite to the positioning member 34, the rotating member 36 is inserted into the second receiving hole 141 to rotate.

One end of the elastic member 38 connects with the first fixing groove 1231 and another end of the elastic member 38 connects with the second fixing groove 3411 to provide an elastic strength when the fixing position 34 needs to move toward the protrusion 1211. When the USB connector 30 is quiescent, the elastic strength of the elastic member 38 makes the protrusion 1211 mesh with the positioning groove 3433.

To assemble the data device with USB connector 100, the position portion 343 is surrounded on the fixing portion 341. The positioning member 34 is inserted into the first receiving hole 121, the rotating member 36 is inserted into the second receiving hole 141, the connecting member 32 is positioned between the first receiving portion 12 and the second receiving portion 14. One end of the elastic member 38 is connected with the first fixing groove 1231 and another end of the elastic member 38 is connected with the second fixing groove 3411. The first cover 101 is coved with the second cover 103.

The USB connector 30 is received in the receiving portion 16 when not used. When used, the USB connector 30 is rotated, a top portion of the protrusion 1211 is resisted at a side of the positioning groove 3433 of the positioning portion 343, thus, the positioning member 34 moves toward a direction away from the protrusion 1211. The USB connector 30 continues to be rotated to a required angle, once the USB connector 30 stops to be rotated, the electric strength of the elastic member 38 drives the positioning member 34 to move toward the protrusion 1211, the protrusion 1211 is inserted into the positioning groove 3433 to fasten the USB connector 30 on the base portion 11.

The surface of the first receiving hole 121 protrudes to form the protrusion 1211. In present embodiment, the positioning portion 343 is received in the first receiving hole 121 and includes a plurality of positioning gears 3431. The protrusion 1211 is combined with the positioning groove 3433 to fasten the USB connector 30 relative to the main body 10 at any angle.

In other embodiments, the direction of the long axis of the first receiving hole 121 is not parallel to the direction of the first pivoting portion 12 extending from the base portion 11, correspondingly. The protrusion 1211 is formed on the surface of the first receiving hole 121 away from the base portion 11. The protrusion 1211 is not formed in the intersection of the long axis and the surface of the first receiving hole 121, but only formed on the surface of the receiving hole 121, which ensures the positioning portion 343 can rotate to any angle in the first receiving hole 121.

In other embodiments, the first receiving hole 121 is not ellipse, just a hole, ensuring the protrusion 1211 can be inserted into the positioning groove 3433. For example, the first receiving hole 121 is a rectangular, ellipse or a circle. Correspondingly, the position of protrusion 1211 may be changed, for example, when the fixing receiving hole 121 is a rectangle, the protrusion 1211 is on the short side of the rectangle. Correspondingly, the position of the protruding post 123 changes, to ensure the protruding post 123 is located at the side of the first receiving hole 121 close to the protrusion 1211.

In other embodiments, there is no first pivoting groove 120. The first receiving hole 121 is formed on the side of first pivoting groove 120 close to the second pivoting portion 14 and through the first pivoting portion 12. Correspondingly, the protruding post 123 is formed on the side of the first pivoting portion 12 away from the protrusion 1211.

In other embodiments, there is no second pivoting groove 140, the second receiving hole 141 is formed on the side of the second pivoting portion 14 close to the first pivoting portion 12, the rotating member 36 is fixed in the second receiving hole 141 to rotate.

In other embodiments, the rotating member 36 is same as the positioning member 34. Correspondingly, the second pivoting portion 14 defines a protruding post, an elastic member, and a protrusion.

In other embodiments, there is no rotating member 36, the position member 34 connects with the first pivoting portion 12, correspondingly, there is no the second pivoting portion 14.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A data device with a USB connector, comprising:

a main body comprising a first cover, a first pivoting portion formed on the first cover, a first receiving hole defined in the first pivoting portion, a protrusion formed on a surface surrounding the first receiving hole and protruding toward a middle of the first receiving hole, a protruding post formed on the first pivoting portion, the protruding post being away from the first receiving hole; and a USB connector comprising a connecting portion, a connecting member, an elastic member and a positioning member formed on the connecting member; wherein one end of the positioning member connects with the connecting portion, another end of the positioning member connects with the main body to rotate, the positioning member is inserted into the first receiving hole to combine the USB connector with the first pivoting portion, the positioning member is capable of moving in the first receiving hole, the positioning member comprises a plurality of positioning gears, the protrusion is inserted between two positioning gears, one end of the elastic member connects with the protruding post and another end of the elastic member connects with the positioning member for providing strength to help the positioning member move to the protruding post.

2. The data device with a USB connector of claim 1, wherein the first receiving hole is shaped as an ellipse, a long axis of the ellipse is parallel with a direction of the first pivoting portion extending from the main body.

3. The data device with USB connector of claim 1, wherein the first cover comprises a base portion and a second pivoting portion, the first pivoting portion and the second pivoting portion extend from one end of the base portion; the second pivoting portion defines a second receiving hole corresponding to the first receiving hole; the USB connector further comprises a rotating member opposite to the positioning member and inserted into the second receiving hole to rotate.

4. The data device with USB connector of claim 3, wherein the main body further comprises a second cover facing and paralleled to the first cover.

5. The data device with USB connector of claim 4, wherein a surface of the first pivoting portion facing the second cover defines a first pivoting groove, the first pivoting groove comprises a first surface opposite to the second pivoting portion; the first receiving hole extends through the first surface and a surface of the first pivoting portion facing the second pivoting portion and communicates with the first pivoting groove; the first surface protrudes to form the protruding post located at same one side the first receiving hole located and adjacent to the base body.

6. The data device with USB connector of claim 5, wherein a surface of the second pivoting portion facing the second cover defines a second pivoting groove, the second receiving hole is located in the surface of the second pivoting portion facing the first pivoting portion and communicates with the second pivoting groove, the second receiving hole is shaped as an ellipse.

7. The data device with USB connector of claim 6, wherein the connecting member comprises a pivoting surface, the pivoting surface is a side surface of the connecting member paralleling and facing the first pivoting portion; the USB connector further comprises a rotating member, the rotating member extends from the side surface of the USB connector, the rotating member is inserted into the second receiving hole to rotate.

8. The data device with USB connector of claim 1, wherein the connecting member comprises a pivoting surface, the pivoting surface is a side surface of the connecting member paralleling and facing the first pivoting portion; the positioning member is located on the pivoting surface, the positioning member comprises a fixing portion protruding from the pivoting surface.

9. The data device with USB connector of claim 8, wherein the protruding post defines a first fixing groove, the fixing portion defines a second fixing groove, one end of the elastic member connects with the first fixing groove and another end of the elastic member connects with the second fixing groove.

10. The data device with USB connector of claim 9, wherein the positioning member further comprises a positioning portion, the positioning portion is located between the pivoting surface and the second fixing groove, and the positioning portion forms the plurality of positioning gears.

* * * * *